US006046509A

United States Patent [19]

LaBaire

[11] Patent Number: 6,046,509

[45] Date of Patent: Apr. 4, 2000

[54] STEAM TURBINE-DRIVEN ELECTRIC GENERATOR

[75] Inventor: William P. LaBaire, Spencer, Mass.

[73] Assignee: Tuthill Corporation, Millbury, Mass.

[21] Appl. No.: 09/141,130

[22] Filed: Aug. 27, 1998

[51] Int. Cl.[7] ..... F01D 15/00

[52] U.S. Cl. ..... 290/52; 60/607

[58] Field of Search ..... 290/52; 60/675, 60/607, 597

[56] References Cited

U.S. PATENT DOCUMENTS

| | | | |
|---|---|---|---|
| 4,018,279 | 4/1977 | Reynolds et al. | 166/258 |
| 4,049,972 | 9/1977 | Crowdy et al. | 290/52 |
| 4,079,263 | 3/1978 | Inoue | 290/52 |
| 4,188,546 | 2/1980 | Kossler | 290/52 |
| 4,253,031 | 2/1981 | Frister | 290/52 |
| 4,362,020 | 12/1982 | Meacher et al. | 60/657 |
| 4,558,228 | 12/1985 | Larjola | 290/52 |
| 4,769,993 | 9/1988 | Kawamura | 60/597 |
| 4,935,656 | 6/1990 | Kawamura | 310/156 |
| 5,045,711 | 9/1991 | Swearingen | 290/52 |
| 5,659,205 | 8/1997 | Weisser | 290/52 |
| 5,831,341 | 11/1998 | Selfors et al. | 290/52 |
| 5,870,894 | 2/1999 | Woollenweber et al. | 60/607 |

*Primary Examiner*—Nicholas Ponomarenko
*Attorney, Agent, or Firm*—Samuels, Gauthier & Stevens

[57] ABSTRACT

A steam turbine-driven generator for generating electric power is comprised of an electric generator having a vertical shaft journalled for rotation between bearings contained in a generator housing. An axial flow impulse turbine wheel with peripheral vanes is secured to an unsupported upper end of the shaft protruding from the top of the generator housing. The turbine wheel is enclosed within a turbine housing secured to the top of the generator housing. The turbine housing includes an inlet and an outlet for accommodating a through flow of steam, with internally arranged nozzles for directing the steam flow against the vanes of the turbine wheel.

13 Claims, 4 Drawing Sheets

STEAM TURBINE-DRIVEN ELECTRIC GENERATOR

BACKGROUND OF THE INVENTION

1. Field of the Invention

This invention relates generally to turbine driven electric generators, and is concerned in particular with the combination of an impulse type steam turbine supported on and closely coupled to an underlying electric generator by means of a common vertical shaft, with the shaft being rotatably supported exclusively by bearings contained in the generator housing.

2. Description of the Prior Art

In large commercial buildings and the like, steam is frequently employed as the energy source for the heating and cooling systems. Typically, the steam is received from an off site generating plant at a relatively high pressure on the order of 150 psig, and is reduced to around 15 psig by conventional pressure reducing valves before being conducted through the building services steam piping. In such cases, the energy lost during the pressure reduction process is not recovered.

In other cases, pressure reduction is effected by passing the steam through conventional horizontal shaft impulse type turbines flexibly coupled to horizontal electric generators, with the two units being mounted and aligned on a fabricated steel baseplate. The energy lost during pressure reduction is thus utilized to generate electricity. However, the net pay back is reduced considerably by high initial equipment costs, with the turbine/generator coupling and base plate being major contributing factors. Other drawbacks of horizontally disposed turbine-generator units include the fact that they occupy considerable floor space, and that the turbine-to-generator alignment required during installation and startup involves mechanical skills considerably above those possessed by typical building maintenance personnel.

It is also known to vertically couple turbines to electric generators. However, such arrangements are either overly complex and expensive, or are otherwise ill suited for use as simple, compact, low-cost energy recovery units which are functionally equivalent to conventional pressure reducing valves.

Accordingly, an object of the present invention is the provision of a close-coupled vertical-shaft impulse-type steam turbine-driven generator unit capable of functioning equivalently to a conventional pressure reducing valve, principally in but not limited to commercial buildings having steam heating and cooling systems. The electricity produced during steam pressure reduction may advantageously be used within the building electrical system to diminish electric power consumption from the local utility.

Another object of the present invention is the provision of a steam turbine-driven generator unit of compact design, which can easily be installed, operated and maintained by relatively unskilled building maintenance personnel.

Still another object of the present invention is the provision of a steam turbine-driven generator unit which is relatively inexpensive in comparison to known designs, thereby maximizing the payback realized from the generation of electricity.

SUMMARY OF THE INVENTION

The present invention provides an improved turbine-driven generator which incorporates the following features and advantages:

a) The turbine is steam-driven as opposed to being driven by water or other liquids, or by organic vapors, the latter being environmentally aggressive and presently disallowed. Steam is widely employed in the heating and cooling systems of large commercial buildings, and is thus a safe and readily available source of power.

b) The turbine is of the impulse type, where virtually all primary energy conversion, i.e., the pressure drop, is in the nozzles. This contrasts sharply with reaction type turbines, where half the pressure drop occurs in the nozzle and the other half occurs in the turbine wheel.

c) The turbine nozzles are fixed and as such are simple in design, robust, reliable, and ideally suited for applications which are to be maintained by limited-skill building maintenance personnel.

d) The turbine is located above and supported by the generator housing. This arrangement affords full access to the turbine elements for inspection and maintenance, and also contributes to a compact space-saving design.

e) The turbine-generator unit is non-hermetic, as opposed to the hermetically sealed units which are normally welded closed and require fluid evacuation, grinding and/or machining in order to gain access to internal components for inspection or repair. Such units must thereafter be rewelded for closure followed by fluid recharging for placement back into service.

f) Steam is directed principally downwardly through the nozzles. This permits effective, natural condensate drainage, which in turn avoids steam path erosion, blading slugging, casing "steam hammer" pressure spikes, thrust load spikes and other "flashing"-related problems.

g) The generator input shaft is supported by two bearings located within the generator housing, with the turbine wheel being carried on an unsupported extension of the input shaft which protrudes vertically into the turbine housing. The input shaft bearings are thus not exposed to or lubricated by the process fluid, in this case steam which is undergoing a pressure drop as it is being circulated through the turbine housing. This additionally contributes to the compactness of the design, as well as its simplicity, reliability and ease of maintenance.

These and other features and advantages of the present invention will be described in greater detail with reference to the accompanying drawings, wherein:

DETAILED DESCRIPTION OF PREFERRED EMBODIMENTS

Figure 1:
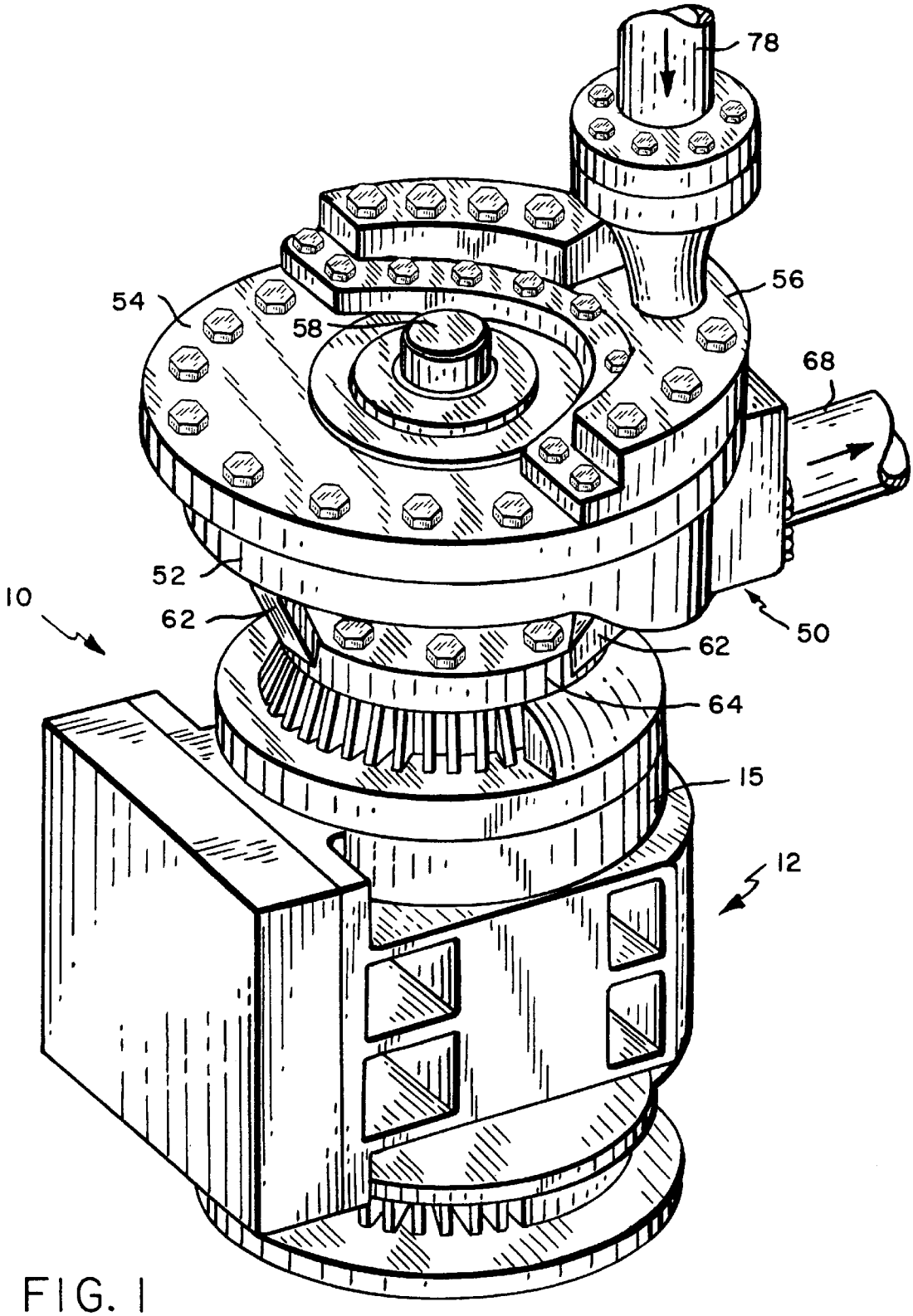
FIG. 1 is a perspective view of a steam turbine-driven generator in accordance with the present invention.
Figure 2:
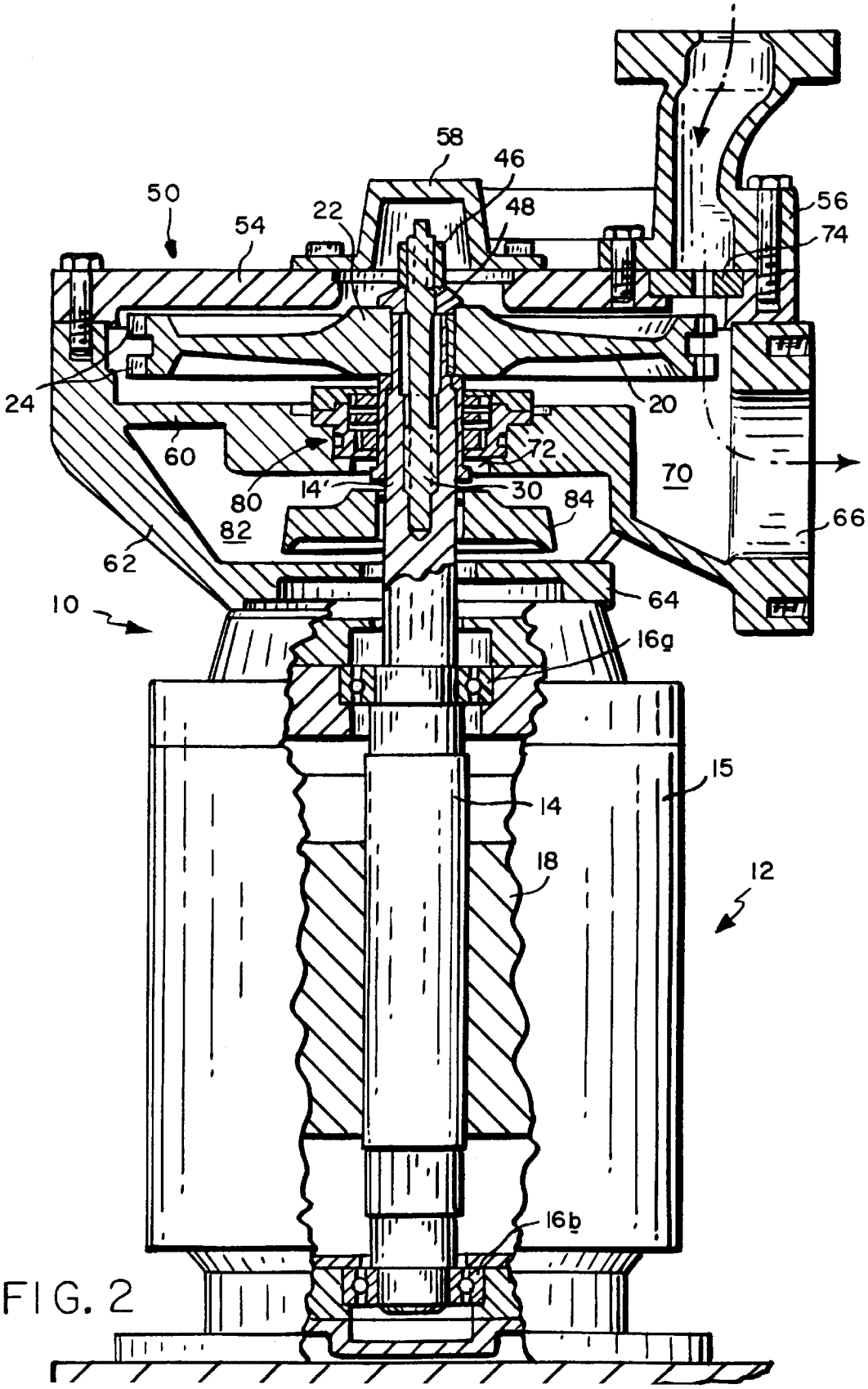
FIG. 2 is a vertical sectional view through the turbine and portions of the underlying generator.
Figure 3:
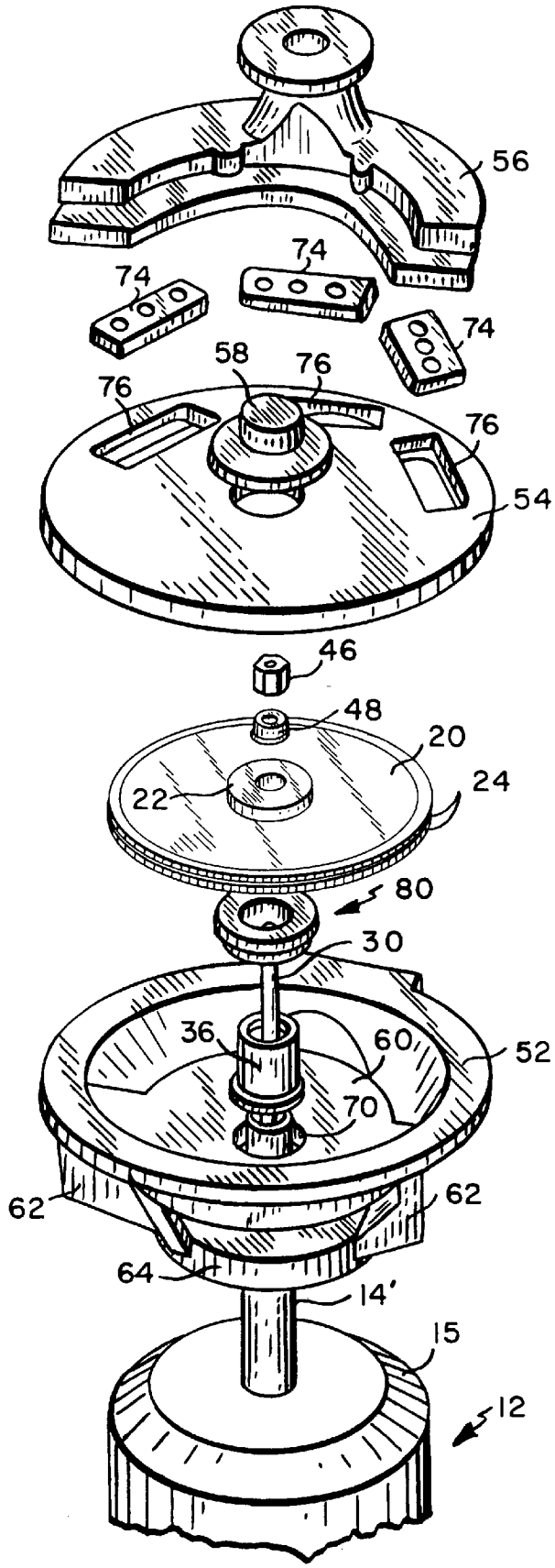
FIG. 3 is an exploded perspective view of the major turbine components.

With reference to the drawings, a steam turbine-driven generator unit in accordance with the present invention is generally depicted at 10. The unit comprises an electric generator 12 having a vertically disposed shaft 14 journalled for rotation between two bearings 16*a*, 16*b* contained in the generator housing 15. The shaft 14 carries a rotor 18 which coacts in a conventional manner with stators (not shown) to generate electricity. The upper end 14' of the input shaft protrudes in an unsupported cantilever fashion from the top of the generator housing. The bearings 16*a,* 16*b* may be of any conventional type, e.g., ball bearings, which may be periodically grease lubricated by hand.

An axial flow impulse turbine wheel 20 is carried on the unsupported upper end 14' of the input shaft. The turbine wheel had a central hub 22 and peripherally arranged vanes 24.

Figure 4:
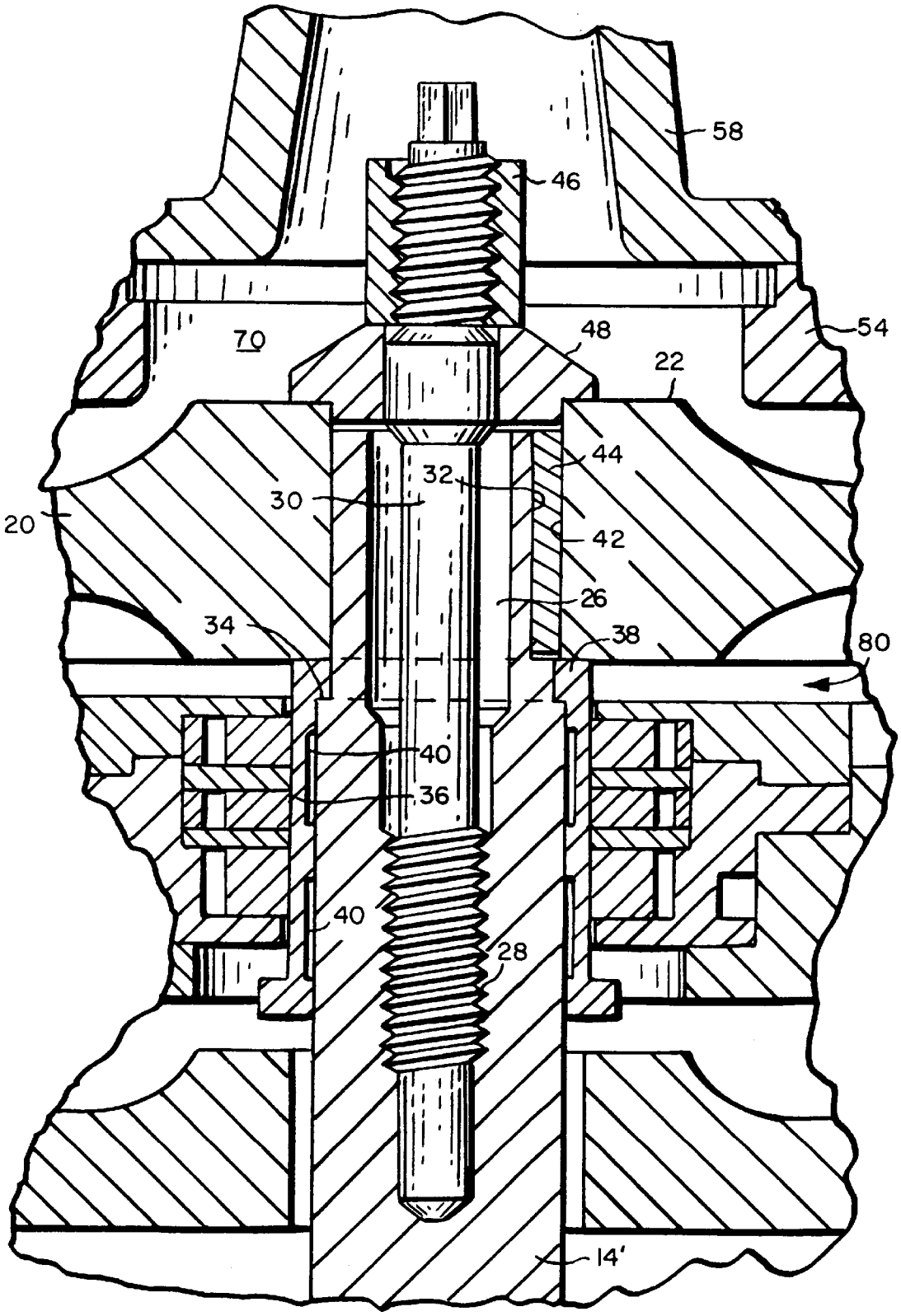
FIG. 4 is an enlarged vertical sectional view of the arrangement for clamping the turbine wheel on the unsupported upper end of the generator shaft.

As best can be seen in FIG. 4, the upper end 14' of the input shaft is hollow as a 26 and is threaded internally to coact as at 28 in threaded engagement with the lower end of a draw bolt 30. The upper shaft end 14' is additionally provided externally with a keyway 32 and a circular shoulder 34. A sleeve 36 is inserted over the upper shaft end 14' and is provided with a radially inwardly protruding lip 38 seated on the shoulder 34. The sleeve 36 is internally provided with axially spaced segments 40 which are spaced radially outwardly from the surface of the input shaft.

The central hub 22 of the turbine wheel 20 is axially received on the hollow upper shaft end 14' at a location axially supported on the upper end of sleeve 36. The hub is provided internally with a keyway 42 which coacts with the external shaft keyway 32 and a key 44 to rotatably locate the turbine wheel on the input shaft.

A locknut 46 is threaded onto the upper end of the draw bolt 30 to act in concert with a retainer washer 48 in axially clamping the turbine wheel hub 22 against the upper end of the sleeve 36, the latter in turn being seated axially against the shaft shoulder 34. It will thus be seen that the turbine wheel 20 is carried exclusively by the unsupported upper end 14' of the generator input shaft, and is rotatably fixed thereon primarily by friction as a result of its being clamped between the upper end of the sleeve 36 and the locknut 46 acting through the retainer washer 48.

A turbine housing 50 overlies and is supported by the generator housing 15. The turbine housing includes an upwardly open exhaust casing 52, a cover 54, an inlet manifold 56 and a cap 58. The exhaust casing 52 has a bottom wall 60 and mutually spaced support struts 62 which depend downwardly from the bottom wall to a circular collar 64 seated on the top of the generator housing 15. An outlet 66 in the exhaust casing is adapted to be connected to exhaust piping 68 (shown only in FIG. 1). The cover 54 is bolted to the exhaust casing 52 and cooperates therewith to define a steam chamber 70. The unsupported upper end 14' of the input shaft protrudes upwardly through an opening 72 in the bottom wall 60 to support the turbine wheel 20 within the steam chamber 70.

Nozzle blocks 74 are fixed in appropriately configured openings 76 in the cover 54. The inlet manifold 56 is bolted to the cover 54 at a location enclosing the nozzle blocks 74, and the central cap 58 is also bolted to the cover at a location enclosing the upper end of the draw bolt 30 and locknut 46. The inlet manifold 56 is adapted to be connected to a steam supply pipe 78 (FIG. 1) which carries steam at an elevated pressure of say 150 psig to the inlet manifold 56. From here, the steam is directed downwardly via the nozzle blocks 74 to impinge upon the peripheral vanes 24 of the turbine wheel 20. The turbine wheel 20 and input shaft 14 are thus rotatably driven with an accompanying reduction in steam pressure, resulting in steam exiting the chamber 70 via outlet 66 at a pressure of about 12 to 15 psig.

A seal assembly 80 prevents steam being circulated through the chamber 70 from escaping between the shaft 14 and the exhaust casing 52 through the opening 72 in the chamber bottom 60. The seal assembly includes inner components carried by the sleeve 36 for rotation with the input shaft 14, and outer components carried by and fixed relative to the chamber bottom 60.

The depending struts 62 are spaced one from the other and from the input shaft 14 to define a space 82 between the chamber bottom 60 and the underlying generator housing 15 which is open to the surrounding atmosphere. A flinger 84 is secured to the shaft 14 for rotation therewith within the space 82. The flinger 84 serves the dual purpose of radially ejecting any gravity flow of condensate from the seal assembly 80, and of entraining ambient air into the space 82.

In light of the forgoing, it will now be appreciated by those skilled in the art that the present invention includes a combination of advantageous features not offered by conventional turbine drive generator units. For example, the unit is inherently self aligned because the turbine wheel 20 is clamped directly to the upwardly protruding end 14' of the input shaft, the latter being rotatably supported exclusively by the bearings 16*a,* 16*b* contained in the generator housing 15. The mounting of the turbine housing 50 directly on the generator housing 15 produce a compact space saving unit. The turbine housing may be readily disassembled to gain access to the nozzle blocks 74, turbine wheel 20, seal assembly 80, etc., thereby facilitating routine maintenance. The annular space between the hollowed upper shaft end 26 and the draw bolt 30 serves to impede heat conduction from the turbine wheel 20 to the input shaft 14. Heat conduction from the casing bottom 60 to the input shaft is further impeded by the radially spaced segments 40 of the sleeve 36 supporting the inner components of the seal assembly 80.

Heat is also dissipated by ambient air flowing through the open space 82 between the bottom wall 60 of the steam chamber and the top of the generator housing 15. Air flow through space 82 is further encouraged by rotation of the shaft-mounted slinger 84.

The fixed nozzle blocks 74 and the generally downward steam flow through the turbine housing contribute further to a reliable easy to maintain unit.

I claim:

1. A steam turbine-driven generator for generating electric power, comprising:

an electric generator having a vertical shaft journalled for rotation between bearings contained in a generator housing, said vertical shaft having an unsupported upper end protruding from the top of said generator housing;

an axial flow impulse turbine wheel having a central hub and peripherally arranged vanes;

clamping means for securing the central hub of said turbine wheel to the unsupported upper end of said vertical shaft;

a turbine housing supported by said generator housing, said turbine housing defining a chamber containing the upper end of said vertical shaft and the turbine wheel secured thereto, said turbine housing having an inlet and an outlet positioned to accommodate a downward flow of steam through said chamber; and nozzle means for directing said steam flow against the vanes of said turbine wheel to rotatably drive said vertical shaft.

2. The steam turbine-driven generator of claim 1 wherein said clamping means includes a draw bolt arranged coaxially with and threaded into the unsupported upper end of said vertical shaft, said draw bolt having a threaded upper end protruding vertically from the upper end of said vertical shaft, and a lock nut coacting with the threaded upper end of said draw bolt to frictionally secure the hub of said turbine wheel against rotation relative to said vertical shaft.

3. The steam turbine-driven generator of claim 2 wherein the upper end of said vertical shaft is hollow.

4. The steam turbine-driven generator of claim 3 wherein the hollow upper end of said vertical shaft forms a cylindrical wall surrounding and spaced radially outwardly from said draw bolt.

5. The steam turbine-driven generator of claim 1 wherein said turbine housing further comprises support means for maintaining a space open to the surrounding atmosphere between said chamber and the generator housing.

6. The steam turbine-driven generator of claim 5 wherein said support means comprises integral struts mutually spaced one from the other and from said vertical shaft.

7. The steam turbine-driven generator of claim 5 wherein said chamber is partially defined by a bottom with an opening through which said vertical shaft protrudes, with a seal assembly being provided to prevent steam being circulated through said chamber from escaping through said opening.

8. The steam turbine-driven generator of claim 7 wherein said seal assembly includes inner components rotatable with said vertical shaft, and outer components carried by and fixed relative to said bottom.

9. The steam turbine-driven generator of claim 8 wherein the inner components of said seal assembly are supported on a sleeve surrounding said vertical shaft.

10. The steam turbine-driven generator of claim 9 wherein said sleeve has axially spaced segments spaced radially outwardly from the surface of said vertical shaft.

11. The steam turbine-driven generator of claim 10 wherein said sleeve has an inwardly protruding circular lip at an upper end thereof, said lip being seated on a circular external shoulder on said vertical shaft.

12. The steam turbine-driven generator of claim 11 wherein the central hub of said turbine wheel is axially urged against the upper end of said sleeve by said clamping means.

13. The steam turbine-driven generator of claim 5 further comprising a flinger carried by said vertical shaft for rotation therewith within said space.

* * * * *